US006308346B1

(12) United States Patent
Brill et al.

(10) Patent No.: US 6,308,346 B1
(45) **Date of Patent: *Oct. 30, 2001**

(54) HYGIENIC TOILET SEAT

(75) Inventors: Alan Brill, Delray Beach; John Bollea, Lighthouse Point, both of FL (US); Dale Hoover, Los Gatos, CA (US)

(73) Assignee: Brill Hygienic Products, Inc., Delray Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/376,166

(22) Filed: Aug. 17, 1999

Related U.S. Application Data

(63) Continuation of application No. 09/156,588, filed on Sep. 18, 1998, now Pat. No. 5,937,448.

(51) Int. Cl.[7] ..... A47K 13/14

(52) U.S. Cl. ..... 4/243.2; 4/243.1; 4/244.2

(58) Field of Search ..... 4/243.2, 245.1, 4/243.1, 243.3, 244.1, 244.2

(56) References Cited

U.S. PATENT DOCUMENTS

| | | |
|---|---|---|
| 4,213,212 | 7/1980 | Hefty et al. . |
| 4,662,009 | 5/1987 | Heft . |
| 4,847,922 | 7/1989 | Iue-Tzung et al. . |
| 5,253,372 | 10/1993 | Boker . |
| 5,685,024 | 11/1997 | Chu et al. . |

*Primary Examiner*—David J. Walczak
(74) *Attorney, Agent, or Firm*—Akerman, Senterfitt

(57) ABSTRACT

An improved electromechanical assembly advances a tubular protective covering around a toilet seat. The covering is stored on a reel, and pulled off from the reel as it is replaced, and the used covering is taken up on a second reel. An activation button exposed through the top of the assembly is depressed to actuate a switch assembly which, in turn, actuates a drive mechanism. By actuating the drive mechanism, the cover is moved through a predetermined distance in such a manner that when it is in the mounted position, the toilet seat body is completely surrounded by the tubular cover. An upper housing portion has an integral pressure blade for exerting a constant downward force on the advancing protective covering. The pressure ensures adequate contact between the covering and a counter shaft assembly which communicates magnetically with internal electronic circuitry.

9 Claims, 4 Drawing Sheets

HYGIENIC TOILET SEAT

CROSS-REFERENCE TO RELATED APPLICATION

This application is a continuation of Ser. No. 09/156,588, filed Sep. 18, 1998, now U.S. Pat. No. 5,937,448.

FIELD OF THE INVENTION

This invention relates generally to hygienic toilet seats and more particularly to an improved electromechanical assembly for fitting and changing a tubular cover of plastic film on a toilet seat.

BACKGROUND OF THE INVENTION

Toilet seats having a device for hygienic covering by a tubular film are known. For example, expired U.S. Pat. No. 4,213,212 to Hefty et al. teaches an arrangement for fitting and changing a tubular cover made of plastic film on a horseshoe shaped toilet seat. Generally, a roll of tubular toilet seat cover material extends from a supply reel, around the seat, to a take-up reel. The tubular cover is advanced one seat length between uses. The supply and take-up reels are contained, along with a motor, electric power source and pulley/gear arrangement, in a housing. In operation, the user actuates the motor by pressing a button or pulling a lever, thereby advancing the covering to provide one complete replacement of the tubular cover around the seat.

Various features of the device taught by Hefty et al. are capable of being improved upon. For instance, the known device does not include a means for detecting resistance changes during advancement of the tubular covering. Consequently, in instances where the cover material is torn or snared, the motor and gear assembly will continue to operate despite the lack of advancement of cover material around the seat. Furthermore, the quantity of covering material advanced may be insufficient due to slipping of tubing on the take up reel. Other limitations include extensive reliance on mechanical parts, such as gears, pulleys and belts, which are susceptible to failure. It would be desirable to provide an improved device overcoming the aforementioned limitations.

SUMMARY OF THE INVENTION

An improved sanitary toilet seat assembly is provided for advancing tubular plastic around a toilet seat. The assembly comprises a toilet seat having a first and a second end and a base member to which the toilet seat is operatively connected. A top cover is provided for covering at least a portion of the base member, thereby forming a housing. A dispenser shaft is provided proximate to the first end, and a take-up shaft is provided proximate the second end. Tubular plastic forms a roll around the dispenser shaft which extends around the toilet seat and forms a roll around the take-up shaft. A motor is provided within the housing for operatively driving the take-up shaft to advance the tubular plastic. A pressure plate is also positioned within the housing to engage and deflect the tubular plastic.

The pressure plate can be integrally formed with the top cover. The pressure plate can engage the tubular plastic to produce a deflection of the tubular plastic, the deflection having a component parallel to a translation direction of the tubular plastic. The assembly can further comprise a counter shaft attachable to at least one magnet and positioned within the housing proximate to the take-up shaft and a control system for controlling advancement of the tubular plastic through the take-up shaft responsive to rotation of the counter shaft. The pressure plate can extend substantially downwardly, from the top cover and engage the tubular plastic for deflecting the tubular plastic under tension in a substantially downward direction, the tubular plastic contacting and rotating the counter shaft as it advances to the take-up shaft. The pressure plate increases contact of the tubular plastic with the counter shaft.

The control system can include electronic circuitry on a printed circuit board to detect resistance in the advancement of the tubular sheet by monitoring counter shaft rotation. The electronic circuitry can halt operation of the motor upon detection of a specified resistance limit in the advancement of the tubular sheet. The assembly can further comprise a heat shrinkable plastic wrapped around the motor. The motor can be initially activated by an activation button.

An improved cover for a sanitary toilet seat assembly for advancing tubular plastic from a roll around a dispenser shaft, around a toilet seat, and onto a roll around take-up shaft is driven by a motor initiated by an activation button. The toilet assembly has a base for supporting the dispenser shaft, the take-up shaft and the toilet seat. The cover comprises a cover body defining an upwardly concave interior cavity having an open bottom terminating at a rim. The rim has a length and a transverse width, the body having two openings along the length of the rim for passage of the tubular plastic during use. The cover body has an aperture for receiving the activation button. The cover body provides a pressure plate which extends within the cavity toward the open bottom, the pressure plate being aligned along the length with one of the openings. The cover, when mounted on the base member covers the dispenser shaft, the take-up shaft and the motor. This arrangement permits passage of the tubular plastic out of the cover, around the toilet seat and back into the cover through the openings and provides the pressure plate for engaging and deflecting the tubular plastic.

DETAILED DESCRIPTION OF THE PREFERRED EMBODIMENTS

An improved electromechanical toilet seat assembly is provided for automatically advancing a tubular sheet of sanitary covering material around a horseshoe-shaped toilet seat. A roll of seat covering material is provided on a dispense shaft and consists of two plastic layers joined at opposite edges to form a tubular structure. In use, the covering material fits snugly around the toilet seat, yet is sufficiently loose to be advanced around the seat without tearing.

Figure 1:
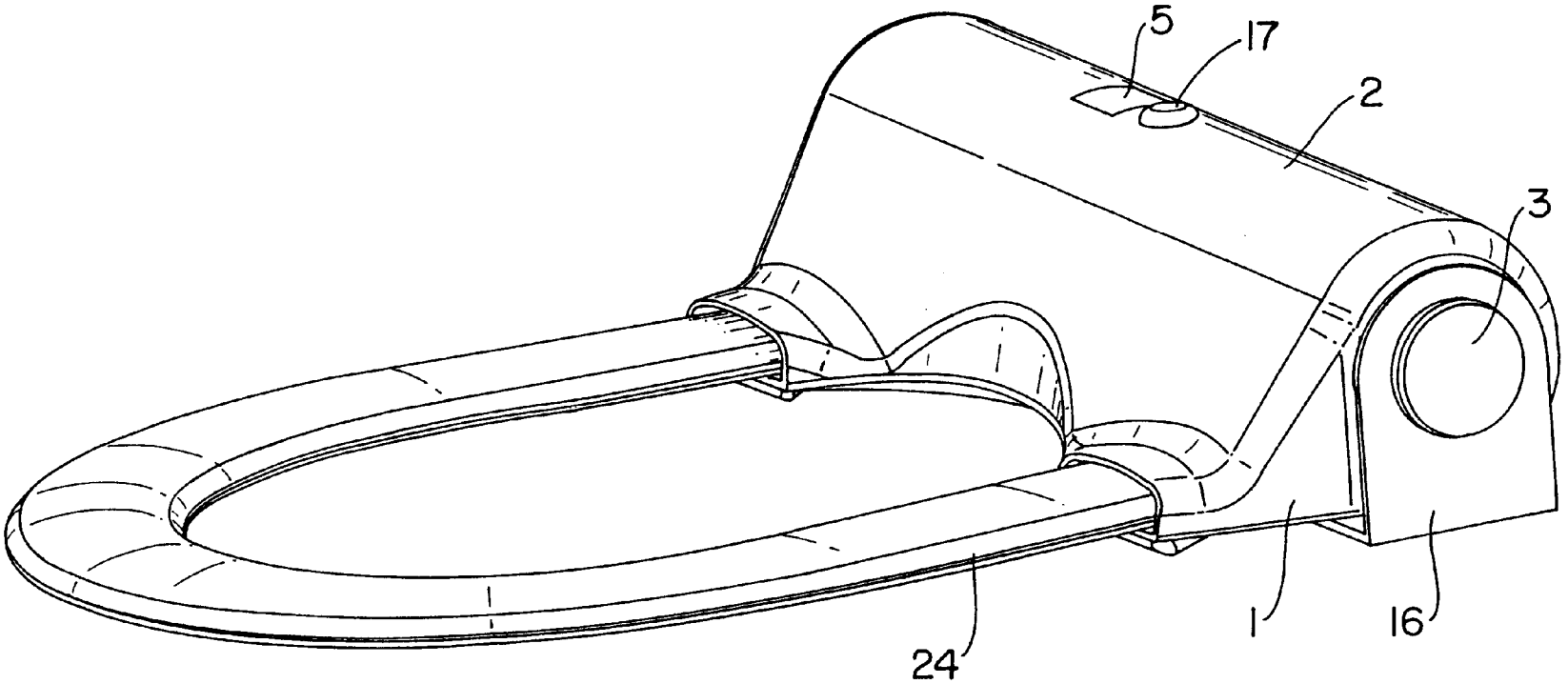
FIG. 1 is a perspective view of an assembled toilet seat in accordance with the present invention.

FIG. 1 illustrates an assembled improved hygienic toilet seat in accordance with the present invention. The major structural components of the assembly include a base member 1, a top cover 2, a seat 24 and a mounting bracket 16. As assembled, base member 1 and top cover 2 form a housing for protecting various internal components, including a motor subassembly 13 and electronic circuitry (not shown in FIG. 1). The improved seat assembly further incorporates heat shrink wrapping 55 over the motor subassembly to prevent potentially harmful agents, such as cleaning chemicals, from deteriorating motor subassembly components. An activation button 5 is exposed through an opening in the top cover 2. A standard key lock 17 is provided for locking the top cover in place. In operation, the activation button is manually depressed to advance the sanitary covering a sufficient length to provide a fresh seat covering. A mounting bracket 16 is provided for attaching the unit to the base of a toilet. End caps 3 extending through aligned circular openings in mounting bracket 16 and base member 1, allow the entire seat assembly to be rotated about an imaginary axis joining the centers of the end caps.

Figure 4:
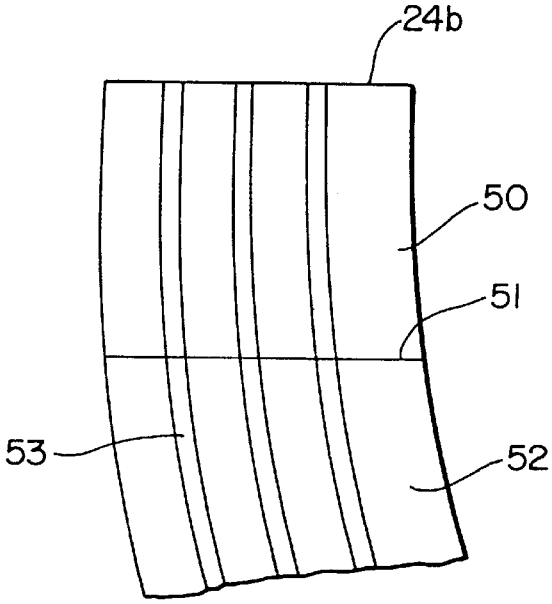
FIG. 4 is a partial bottom view of a toilet seat having structural support ribs in accordance with the present invention.
Figure 5:
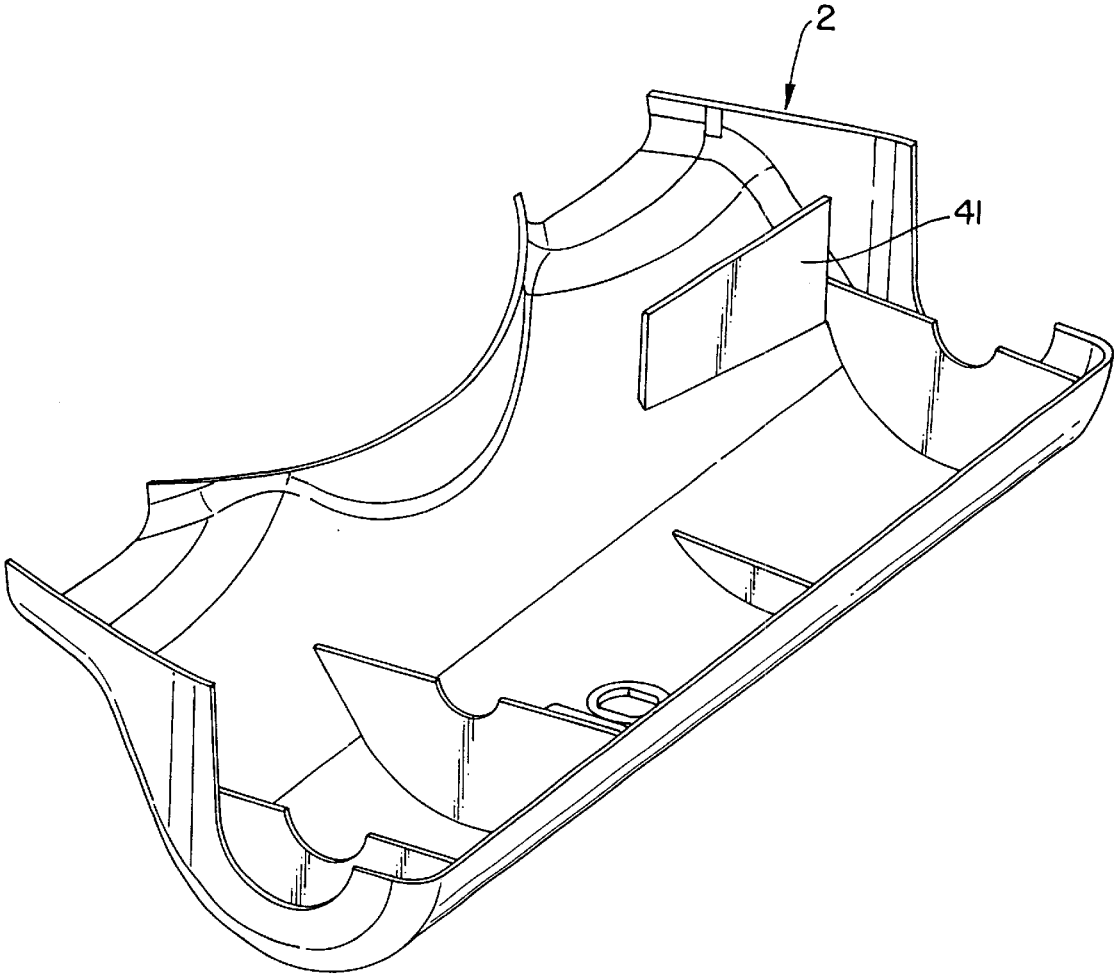
FIG. 5 is a perspective view of the inside surface of a top cover of the assembly in accordance with the present invention.

Structurally, components of the improved seat assembly are designed to provide improved mechanical strength. For instance, seat 24 has ribs extending completely around its underside. In particular, the ribs extend from end 24*a* to end 24*b*. Referring briefly to FIG. 4, a bottom view of seat end 24*b* is shown. Region 50 adjacent end 24*b* is generally thicker than the remainder of the seat. It is known to incorporate ribs to provide added structural support to the thinner portion of the seat. However, known seat assemblies have included support ribs 53 extending along the length of the seat terminating at the interface 51 between sections 50 and 52. According to the improved structure of the present invention, support ribs extend through the thickened section 50. As a result, the bending strength at interface 51 has been increased.

The improved seat assembly will now be described in more detail. Base member 1 preferably comprises a unitary molded plastic having a number of integrally molded support structures. In addition, the new seat assembly incorporates drain holes 57 extending through the bottom of the base member 1 to allow removal of fluids which could potentially accumulate in the housing and deteriorate internal components. Base member 1 includes partitions 30 and 31 for supporting a dispense roll shaft 54. Opposite ends of the dispense roll shaft are supported on recesses 32 formed in partitions 30 and 31. The improved seat assembly also incorporates integral stop mechanisms 33 for limiting horizontal movement of the dispense roll shaft.

The tubular cover material fits over free seat end 24*a*, which is not attached to the assembly. The cover material extends completely around the seat 24, over counter shaft 4, and is ultimately rewound on a take-up shaft 37. The take-up shaft is supported at one end by spring plate 11 attached to the outer surface of partition 38. The opposite end of the take-up roll mates with drive motor hub 8 which is attached to a drive shaft (not shown) extending from an end of motor 13.

Toilet seat 24 has a slot 26 formed at one end for attachment of plate 34 and razor subassembly 25. Threaded studs 23 extending from attachment plate 9 pass through openings in base member 1 and plate 34. Attachment plates 9 and 34 are mechanically fastened to the base member. A portion of attachment plate 34 is integrally molded into slot 26 of seat 24.

Figure 3:
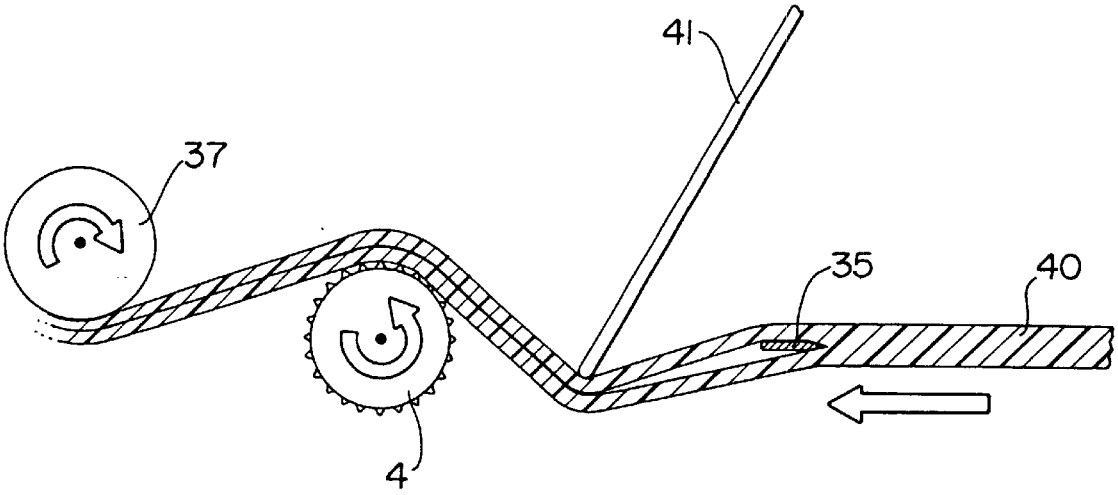
FIG. 3 is a schematic view illustrating improvements in the take-up region of the toilet seat assembly according to the present invention.

Razor subassembly 25, which fits into a wider section of slot 26, has an integrally molded raised bump formed on its surface for mating with an opening in plate 34. This feature of the improved assembly provides a means for releasably locking the razor blade assembly in place. The razor extends at an obtuse angle in relation to the advancing covering material, and serves to slit the edge of the cover material in order to allow it to be pulled off and wound up on the take-up shaft. Referring briefly to FIG. 3, as the tubular cover material 40 is advanced, the edge of the tubular covering adjacent the inside edge of the toilet seat contacts razor 35, slitting the side to allow it to pass plate 34 (not shown in FIG. 3) for receipt on take-up shaft 37. The improved seat assembly has an integral pressure plate 41 extending downward at an angle from the inner surface of top cover 2. Integral pressure plate 41 serves to press advancing cover material 40 against counter shaft 4 to improve contact between the cover material and the outer surface of the counter shaft.

Figure 2:
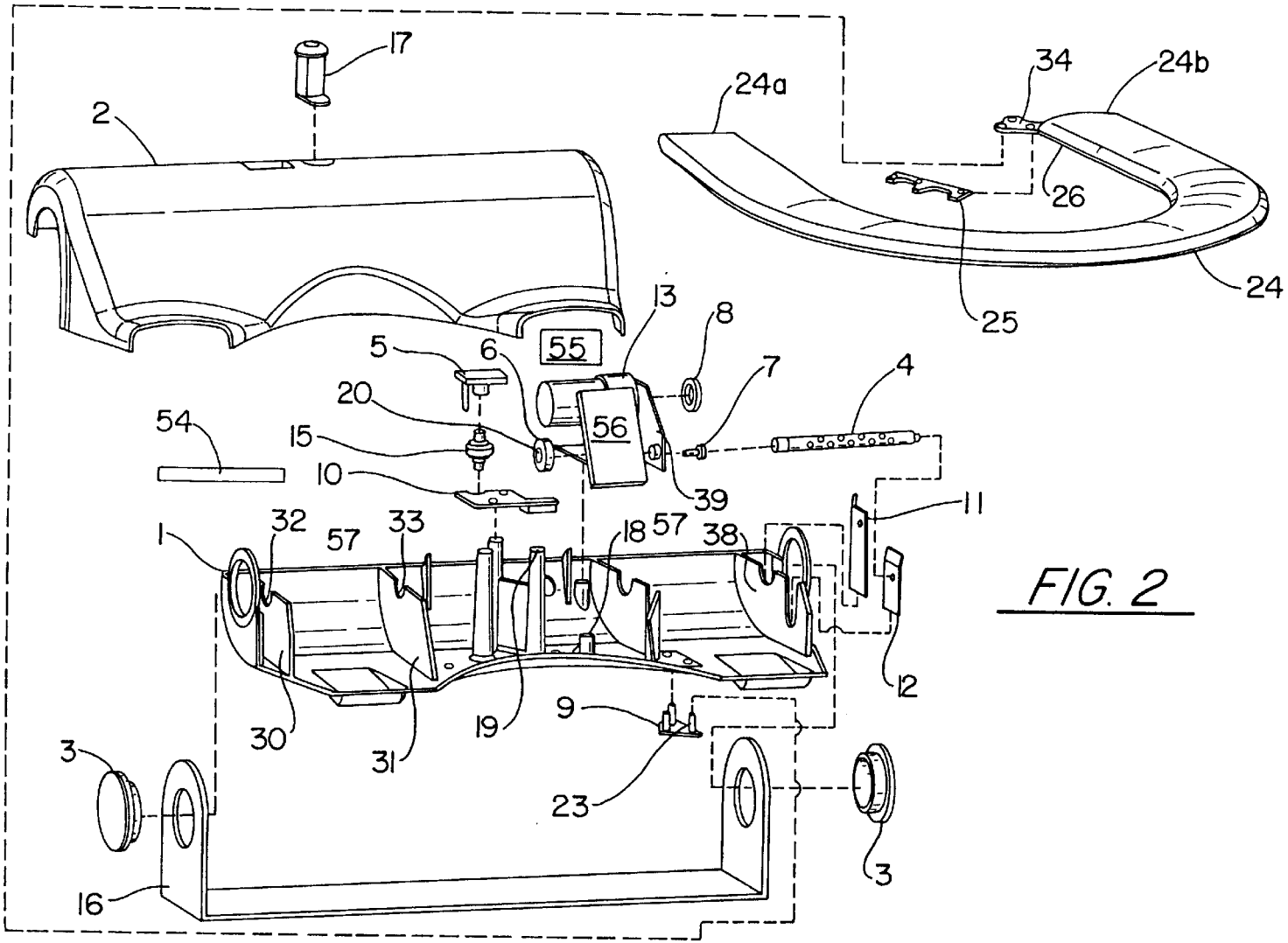
FIG. 2 is an exploded view of a toilet seat assembly in accordance with the present invention.

Referring back to FIG. 2, counter shaft 4 is supported at one end by spring plate 12 attached to the outer surface of partition 38. The opposite end of counter shaft 4 is joined to magnet wheel 6 via counter drive shaft element 7 extending through an opening in motor support plate 39. Counter shaft 4 is preferably formed of a molded plastic and has a plurality of integrally molded raised surface portions for gripping advancing cover material. In particular, the raised surface portions improve friction between the advancing cover material and the counter shaft surface, thereby improving rotational precision of the counter shaft during advancement of the cover material. As previously stated, the improved seat assembly incorporates a pressure plate integrally molded into top cover 2. In an assembled state, the pressure plate applies a downward force on the advancing cover material to further improve contact between the advancing cover material and the counter shaft surface.

Magnet wheel 6 has a magnet 20 attached to an outer wheel surface. The magnet 20 faces and communicates with electronic circuitry mounted on a printed circuit board assembly 56. The electronic circuitry of the improved assembly precisely monitors the number of rotations of wheel 6. Rotation of wheel 6 is a direct result of rotation of counter shaft 4. Consequently, resistance in the advancement of cover material, which affects the rotation of shaft 4, is detected by the electronic circuitry. In contrast to known devices, the circuitry of the present invention is designed to halt operation of motor 13 in instances where a specified resistance level is encountered. Motor subassembly 13 is preferably supplied approximately 12 volts dc which can be supplied via a 12 v dc converter or, alternatively, the assembly can be operated with batteries.

In contrast to prior art designs, the improved assembly of the present invention incorporates an activation button 5 operating independently of internal mechanical components, including the dispense and take up roll shafts. Consequently, activation of the assembly is not dependent upon the mechanical integrity of other assembly components. Furthermore, the button 5 has an improved ergonomic design which is less prone to damage by external forces. In a released state, the upper surface of activation button 5 lies substantially flush with the upper surface of top cover 2 and the sides of the button are bounded by the periphery of the opening in the top cover through which the button is exposed. As a result, activation button motion is limited to vertical displacement upon contact. The activation button 5 also has an integrally molded guide leg 42 which is received in an opening in push switch assembly support plate 10 to prevent rotation of activation button 5 as it is being depressed. Support plate 10 is mechanically fastened to support plate mounting structure 19 integrally formed in base member 1. The improved structural integrity has resulted in an assembly having a corresponding reduction in required maintenance.

In operation, activation button 5 is pushed to actuate switch assembly 15 for activating motor assembly 13. A drive shaft extending from motor assembly 13 rotates hub 8 which, in turn, rotates the take-up shaft. As the take-up shaft is rotated, cover material is pulled off of the dispense shaft roll and advanced around toilet seat 24. Advancing cover material is forced against the outer surface of counter shaft 4 by pressure plate 41, causing counter shaft 4 to rotate. Rotation of the counter shaft 4 effects corresponding rotation of magnet 20 on magnet wheel 6. At seat end 24*b*, the left inside-facing edge of the cover is slit by razor assembly 25 in order to allow it to be wound up on take-up shaft 37. The amount of material advanced is determined by rotation of counter shaft 4. Specifically, rotations are computed by electronic circuitry (not shown) which tracks the rotation of magnet 20 on magnet wheel 6. Where specified resistance limits are exceeded, the electronic circuitry communicates with motor assembly 13 to halt operation of the motor.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A sanitary toilet seat assembly for advancing tubular plastic around a toilet seat, said assembly comprising:

a toilet seat having a first end and a second end;

a base member to which the toilet seat is operatively connected;

a top cover covering at least a portion of the base member, thereby forming a housing;

a dispenser shaft proximate said first end; a take-up shaft proximate said second end; tubular plastic forming a roll around said dispenser shaft, extending around said toilet seat, and forming a roll around said take-up shaft;

a counter shaft;

a motor within said housing for operatively driving said take-up shaft to advance said tubular plastic in a travel direction; and a unitary pressure member for forcing the tubular plastic against said counter shaft, said pressure member extending continuously in a unitary construction downward from an upper internal surface of said top cover to a stationary pressure edge, said pressure edge having a long axis and a short axis defining a contact area with the tubular plastic, said long axis substantially transverse to said travel direction, whereby contact between said tubular plastic and said counter shaft is improved.

2. The assembly of claim 1, wherein said pressure member is integrally permanently and unitarily formed with the top cover.

3. The assembly of claim 1, wherein said pressure member engages said tubular plastic to produce a deflection of said tubular plastic having a component substantially transverse to said travel direction.

4. The assembly of claim 1, wherein said counter shaft is attachable to at least one magnet and positioned within said housing proximate to said take-up shaft and a control system for controlling advancement of said tubular plastic through said take-up shaft responsive to rotation of said counter shaft, and wherein said pressure member extends substantially downwardly from said top cover and engages said tubular plastic for deflecting said tubular plastic under tension in a substantially downward direction, said tubular plastic contacting and rotating said counter shaft as it advances to said take-up shaft, said pressure plate increasing contact of said tubular plastic with said counter shaft.

5. The assembly of claim 4, wherein said control system includes electronic circuitry on a printed circuit board to detect resistance in the advancement of said tubular sheet by monitoring counter shaft rotation.

6. The assembly of claim 5, wherein said electronic circuitry halts operation of said motor upon detecting a specified resistance limit in the advancement of said tubular sheet.

7. The assembly of claim 1, further comprising a heat shrinkable plastic wrapped around said motor.

8. The assembly of claim 1, wherein said motor is initially activated by an activation button.

9. An improved cover for a sanitary toilet seat assembly for advancing tubular plastic from a roll around a dispenser shaft, around a toilet seat, and onto a roll around a take-up shaft in a travel direction driven by a motor initiated by an activation button, the toilet assembly having a base for supporting the dispenser shaft, the take-up shaft and the toilet seat, said cover comprising:

a cover body defining an upwardly concave interior cavity having an open bottom terminating at a rim, said rim having length and a transverse width, said body having two openings along said length of said rim for passage of the tubular plastic during use;

said cover body having an aperture for receiving the activation button;

said cover body providing a unitary pressure member for forcing the tubular plastic downward, said pressure member extending continuously downward in a unitary construction within said cavity from said cover body to a stationary pressure edge directed toward said open bottom, said pressure edge having a long axis and a short axis defining a contact area to contact the tubular plastic, said long axis having substantially transverse to the travel direction of the tubular plastic, said pressure member being aligned along said length with one of said openings, wherein said cover, when mounted on said base member, covers said dispenser shaft, said take-up shaft and said motor and permits passage of said tubular plastic out of said cover, around said toilet seat and back into said cover through said openings and provides the pressure edge for engaging and deflecting the tubular plastic.

* * * * *